US009953759B2

(12) United States Patent
Ozawa

(10) Patent No.: US 9,953,759 B2
(45) Date of Patent: Apr. 24, 2018

(54) COIL COMPONENT

(71) Applicant: MURATA MANUFACTURING CO., LTD., Kyoto-fu (JP)

(72) Inventor: Takeru Ozawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 107 days.

(21) Appl. No.: 15/151,848

(22) Filed: May 11, 2016

(65) Prior Publication Data

US 2016/0372261 A1 Dec. 22, 2016

(30) Foreign Application Priority Data

Jun. 19, 2015 (JP) ..... 2015-123375

(51) Int. Cl.
*H01F 27/29* (2006.01)
*H01F 5/00* (2006.01)
*H01F 17/00* (2006.01)

(52) U.S. Cl.
CPC ..... *H01F 27/292* (2013.01); *H01F 17/0013* (2013.01)

(58) Field of Classification Search
CPC ..... H01F 17/0013; H01F 5/003
USPC ..... 336/192, 200
See application file for complete search history.

(56) References Cited

U.S. PATENT DOCUMENTS 4,543,553 A * 9/1985 Mandai ..... H01F 17/0013 29/602.1
4,689,594 A * 8/1987 Kawabata ..... H01F 17/0013 336/200
4,803,453 A * 2/1989 Tomono ..... H01F 17/0013 336/183
5,945,902 A * 8/1999 Lipkes ..... H01F 17/0013 29/602.1
6,114,936 A * 9/2000 Yamamoto et al. ..... H01F 27/2804 336/192
7,106,161 B2 * 9/2006 Tozawa ..... H01F 17/0013 336/192

(Continued)

FOREIGN PATENT DOCUMENTS

JP 4220453 B2 2/2009

OTHER PUBLICATIONS

J-PlatPat, English Translation of Detailed Description and Claims of JP 42-20453 to Mitsuru.

*Primary Examiner* — Alexander Talpalatski
*Assistant Examiner* — Joselito Baisa
(74) *Attorney, Agent, or Firm* — Studebaker & Brackett PC

(57) ABSTRACT

A coil component includes a component main body, a coil conductor, first and second external terminal electrodes and first and second extended conductor layers The first and second extended conductor layers are extended in directions toward the first main surface from one end portions of the first and second external terminal electrodes in a state of forming uniform and edges, and connect the one end and the other end of the coil conductor and the first and second external terminal electrodes, respectively, with distances larger than distances extending in normal line directions of outer peripheral edges of the circulating conductor layers and equal to or smaller than distances extending in tangent line directions of the outer peripheral edges of the circulating conductor layers.

5 Claims, 10 Drawing Sheets

(56) References Cited

U.S. PATENT DOCUMENTS

| | | | | |
|---|---|---|---|---|
| 8,102,234 | B2 * | 1/2012 | Ozawa | H01F 17/0013 336/200 |
| 8,193,894 | B2 * | 6/2012 | Miyoshi | H01F 17/0013 29/602.1 |
| 8,484,824 | B2 * | 7/2013 | Schantz | B02C 1/00 29/505 |
| 2005/0134420 | A1 * | 6/2005 | Nakao | H01F 19/08 336/234 |
| 2006/0006972 | A1 * | 1/2006 | Tozawa | H01F 17/0013 336/200 |
| 2011/0001599 | A1 * | 1/2011 | Takenaka | H01F 17/0013 336/200 |
| 2014/0145815 | A1 * | 5/2014 | Ishii | H01F 17/0013 336/200 |
| 2015/0009003 | A1 * | 1/2015 | Ozawa | H01F 17/0013 336/200 |

* cited by examiner

COIL COMPONENT

CROSS REFERENCE TO RELATED APPLICATIONS

This application claims benefit of priority to Japanese Patent Application 2015-123375 filed Jun. 19, 2015, the entire content of which is incorporated herein by reference.

TECHNICAL FIELD

The present disclosure relates to a coil component, and in particular, relates to a coil component incorporating a coil conductor in a laminate structure.

BACKGROUND

For example, Japanese Patent No. 4220453 discloses an interesting coil component. Japanese Patent No. 4220453 discloses several examples of a coil component called multilayer inductor and a cross-sectional configuration of a typical example among them is illustrated in FIG. 10.

A coil component 1 includes a component main body 2 with reference to FIG. 10. The component main body 2 has a substantially rectangular parallelepiped shape having first and second main surfaces 3 and 4 opposing each other, first and second side surfaces (which extend in parallel with a paper plane of FIG. 10, not illustrated) opposing each other, and first and second end surfaces 5 and 6 opposing each other. The first and second side surfaces and the first and second end surfaces 5 and 6 connect the first and second main surfaces 3 and 4.

First and second external terminal electrodes 7 and 8 are formed on regions of the second main surface 4 of the component main body 2 at the first end surface 5 side and the second end surface 6 side, respectively. These first and second external terminal electrodes 7 and 8 are formed by applying conductive pastes and baking them, and extend from the second main surface 4 to a part of the first end surface 5 and a part of the second end surface 6, respectively, in substantially L-shaped forms. In other words, the first and second external terminal electrodes 7 and 8 are not formed on the first main surface 3 and on regions of the first and second end surfaces 5 and 6 at the first main surface 3 side.

The component main body 2 has a laminate structure in which a plurality of insulating layers 9 are laminated in a direction orthogonal to the above-described side surfaces. A coil conductor 10 is arranged in the component main body 2. The coil conductor 10 is configured by a plurality of circulating conductor layers 11 each of which extends so as to form a part of a substantially ring-like trajectory along an interface between the insulating layers 9 and a plurality of via hole conductors (not illustrated) penetrating through the insulating layers 9 in a thickness direction thereof. The coil conductor extends in a substantially helical form by alternately connecting the circulating conductor layers 11 and the via hole conductors. In FIG. 10, the coil conductor 10 extending in the substantially helical form is illustrated in a state of being seen through in a direction of a center axis line thereof.

One end and the other end of the coil conductor 10 are connected to the first and second external terminal electrodes 7 and 8, respectively, while first and second extended conductor layers 13 and 14 formed along interfaces between the insulating layers 9 are interposed therebetween.

When the coil component 1 is mounted on a circuit substrate (not illustrated), the second main surface 4 serves as a mounting surface facing the circuit substrate. Accordingly, a direction of magnetic flux that is applied by the coil conductor 10 is parallel with the mounting surface.

SUMMARY

In the coil component 1 as illustrated in FIG. 10, the first and second external terminal electrodes 7 and 8 are present so as to surround overall peripherals of connection places thereof to the first and second extended conductor layers 13 and 14, respectively. Therefore, distances between the first and second external terminal electrodes 7 and 8 and the first and second extended conductor layers 13 and 14 are small. Due to this, shielding of the magnetic flux and generation of stray capacitance are easy to cause lowering of an inductance value and a Q value.

Further, the first and second extended conductor layers and 14 perpendicularly abut against the first and second external terminal electrodes 7 and 8, respectively. Therefore, return loss is large and this point is also easy to cause the lowering of the Q value.

Accordingly, it is an object of the present disclosure to solve the above-described problems and provide a coil component capable of obtaining a higher inductance value and a higher Q value.

According to one embodiments of the present disclosure, a coil component includes a component main body that has a substantially rectangular parallelepiped shape having first and second main surfaces opposing each other, and first and second side surfaces opposing each other and first and second end surfaces opposing each other, which connect the first and second main surfaces, and has a laminate structure in which a plurality of insulating layers are laminated in a direction orthogonal to the side surfaces.

Further, the coil component includes a coil conductor that is arranged in the component main body, is configured by a plurality of circulating conductor layers each of which extends so as to form a part of a substantially ring-like trajectory along an interface between the insulating layers and a plurality of via hole conductors penetrating through the insulating layers in a thickness direction, and extends in a substantially helical form by alternately connecting the circulating conductor layers and the via hole conductors.

Further, the coil component includes first and second external terminal electrodes that are arranged at a region including the second main surface at the first end surface side and a region including the second main surface at the second end surface side, respectively, but are not arranged at the first main surface and regions of the first and second end surfaces at the first main surface side.

Further, the coil component includes first and second extended conductor layers that are arranged along interfaces between the insulating layers and connect one end and the other end of the coil conductor and the first and second external terminal electrodes, respectively.

In the coil component according to the preferred embodiment of the disclosure, the first and second extended conductor layers, when seen in a direction of a center axis line of the coil conductor, are extended in directions toward the first main surface from one end portion of the first external terminal electrode and one end portion of the second external terminal electrode, which are located at farther positions relative to the other external terminal electrodes, respectively, in a state of forming uniform end edges, and connect the one end and the other end of the coil conductor and the first and second external terminal electrodes, respectively, with distances larger than distances extending in normal line directions of outer peripheral edges of the circulating conductor layers and equal to or smaller than distances extending in tangent line directions of the outer peripheral edges of the circulating conductor layers.

As described above, the first and second extended conductor layers are extended from the one end portions of the first and second external terminal electrodes, which are located at the farther positions relative to the other external terminal electrodes, respectively, in the state of forming the uniform end edges. With this, areas of the external terminal electrodes present around connection places thereof to the extended conductor layers can be decreased and return loss of signals moving from the extended conductor layers to the coil conductor can be suppressed.

Further, the first and second extended conductor layers connect the one end and the other end of the coil conductor and the first and second external terminal electrodes, respectively, with the distances larger than the distances extending in the normal line directions of the outer peripheral edges of the circulating conductor layers and equal to or smaller than the distances extending in the tangent line directions of the outer peripheral edges of the circulating conductor layers. Therefore, the lengths and the areas of the extended conductor layers, which do not form circulating portions of the coil conductor, can be suppressed to a minimum.

In a first preferred embodiment of the disclosure, the one end portions of the first and second external terminal electrodes are located at the first and second end surfaces, respectively. That is to say, with this configuration, the external terminal electrodes extend in substantially L-shaped forms.

In the above-described first preferred embodiment of the disclosure, it is further preferable that distances to the one end portions of the first and second external terminal electrodes from the second main surface be smaller than a distance to a center axis line of the coil conductor from the second main surface. With this configuration, shielding of magnetic flux and generation of stray capacitance can be further suppressed.

In a second preferred embodiment of the disclosure, the one end portions of the first and second external terminal electrodes are located at the second main surface. In simple words, the external terminal electrodes are formed at only the second main surface, that is, the bottom surface of the component main body. According to the preferred embodiment, a mounting area of the coil component can be decreased.

In the preferred embodiment of the disclosure, it is preferable that the first and second extended conductor layers extend in forms of curves having centers on outer side portions of the substantially ring-like trajectory when seen in a direction of the center axis line of the coil conductor. With this configuration, in manufacturing of the coil component, even when positional deviation is generated in a cut process of obtaining the end surfaces of the component main body, the extended conductor layers can be made difficult to be cut. Accordingly, dimensions of the external terminal electrodes are not easy to vary.

According to the one embodiment of the present disclosure, as described above, the extended conductor layers are extended from the one end portions of the external terminal electrodes in the state of forming the uniform end edges. With this, the areas of the external terminal electrodes present around the connection places thereof to the extended conductor layers can be decreased. Therefore, the magnetic flux is not easy to be shielded and the stray capacitance is not easy to be generated, thereby obtaining a higher inductance value and a higher Q value.

Further, return loss of the signals moving from the extended conductor layers to the coil conductor can be suppressed and the lengths and the areas of the extended conductor layers, which do not form the circulating portions of the coil conductor, can be suppressed to a minimum. Therefore, increase in electric resistance and influence by shielding of the magnetic flux can be suppressed. With this point, a higher inductance value and a higher Q value can be obtained.

Moreover, the extended conductor layers are extended in the directions toward the first main surface from the external terminal electrodes. Therefore, the extended conductor layers have the same circulating directions as the circulating conductor layers of the coil conductor. Accordingly, these extended conductor layers can also contribute to acquisition of the inductance of the coil conductor efficiently and contribute to an increase in the number of turns in the same laminate plane, as a result. This can also increase the inductance value and the Q value.

Other features, elements, characteristics and advantages of the present disclosure will become more apparent from the following detailed description of embodiments of the present disclosure with reference to the attached drawings.

DESCRIPTION OF THE EMBODIMENTS

Figure 1:
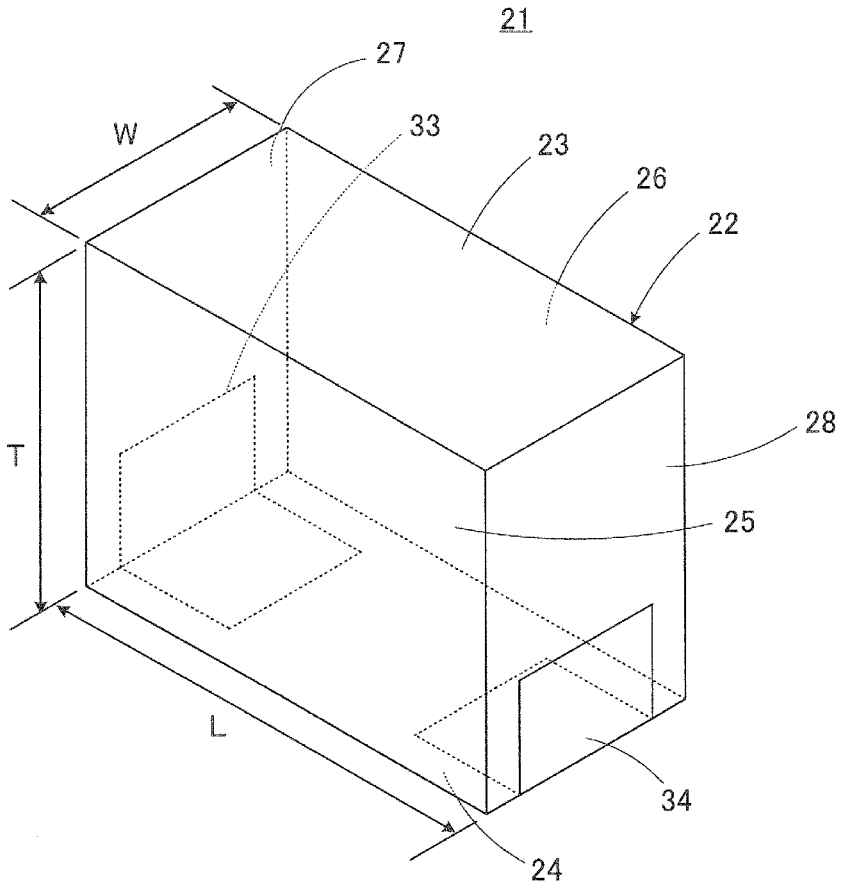
FIG. 1 is a perspective view of an outer appearance of a coil component according to a first embodiment of the present disclosure.

As illustrated in FIG. 1, a coil component 21 according to a first embodiment of the present disclosure includes a component main body 22. The component main body 22 has a substantially rectangular parallelepiped shape including first and second main surfaces 23 and 24 opposing each other, and first and second side surfaces 25 and 26 opposing each other and first and second end surfaces 27 and 28 opposing each other, which connect the first and second main surfaces 23 and 24.

Figure 2:
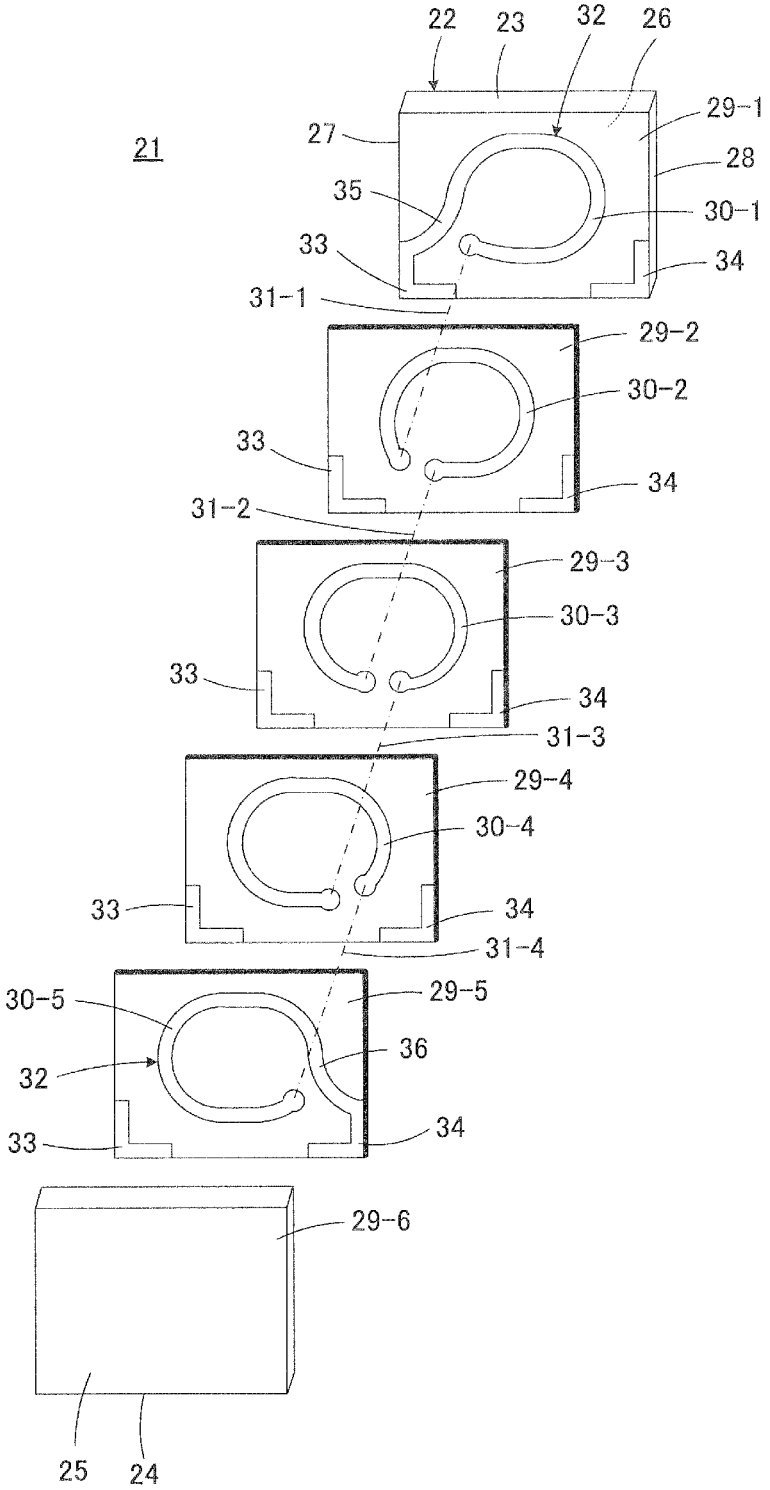
FIG. 2 is a perspective view illustrating the coil component of FIG. 1 in an exploded manner.

As illustrated in FIG. 2, the component main body 22 has a laminate structure in which a plurality of insulating layers 29 are laminated in a direction orthogonal to the side surfaces 25 and 26. FIG. 2 illustrates reference numerals of the insulating layers that are not "29" simply but "29-1", "29-2" . . . and "29-6". When the plurality of insulating layers need to be distinguished from one another for description, the reference numerals of "29-1", "29-2" . . . and "29-6" are used. When the plurality of insulating layers need not be distinguished from one another for description, the reference numeral of "29" is used.

A coil conductor 32 is arranged in the component main body 22. The coil conductor 32 extends in a substantially helical form by alternately connecting a plurality of circulating conductor layers 30 and a plurality of via hole conductors 31. Each of the circulating conductor layers 30 extends so as to form a part of the substantially ring-like trajectory along an interface between the insulating layers 29. The via hole conductors 31 penetrate through the insulating layers 29 in the thickness direction thereof. It should be noted that the reference numerals of the circulating conductor layers and the via hole conductors are used differently in the same manner as those of the above-described insulating layers.

To be more specific, the coil conductor 32 is configured by a circulating conductor layer 30-1, a via hole conductor 31-1, a circulating conductor layer 30-2, a via hole conductor 31-2, a circulating conductor layer 30-3, a via hole conductor 31-3, a circulating conductor layer 30-4, a via hole conductor 31-4, and a circulating conductor layer 30-5 that are connected in order.

Further, the coil component 21 includes first and second external terminal electrodes 33 and 34. In the embodiment, as illustrated in FIG. 1 clearly, the first external terminal electrode 33 and the second external terminal electrode 34 are arranged at a region including the second surface 24 at the first end surface 27 side and a region including the second main surface 24 at the second end surface 28 side. The first external terminal electrode 33 is arranged so as to extend to halfway of the first end surface 27 from a portion of the second main surface 24 at the first end surface 27 side. The second external terminal electrode 34 is arranged so as to extend to halfway of the second end surface 28 from a portion of the second main surface 24 at the second end surface 28 side. In short, the external terminal electrodes 33 and 34 extend in substantially L-shaped forms. That is to say, the first and second external terminal electrodes 33 and 34 are not formed on the first main surface 23 and on regions of the first and second end surfaces 27 and 28 at the first main surface 23 side.

In addition, the coil component 21 includes first and second extended conductor layers 35 and 36. The first and second extended conductor layers 35 and 36 connect one end and the other end of the coil conductor 32 and the first and second external terminal electrodes 33 and 34, respectively. To be more specific, the first extended conductor layer 35 is arranged along an interface the same as an interface between the insulating layer 29-1 and the insulating layer 29-2 on which the circulating conductor layer 30-1 is located and connects the circulating conductor layer 30-1 and the first external terminal electrode 33. The second extended conductor layer 36 is arranged along an interface the same as an interface between the insulating layer 29-5 and the insulating layer 29-6 on which the circulating conductor layer 30-5 is located and connects the circulating conductor layer 30-5 and the second external terminal electrode 34.

When the coil component 21 is mounted on a circuit substrate (not illustrated), the second main surface 24 serves as a mounting surface facing the circuit substrate. Accordingly, a direction of magnetic flux that is applied by the coil conductor 32 is parallel with the mounting surface.

Figure 3:
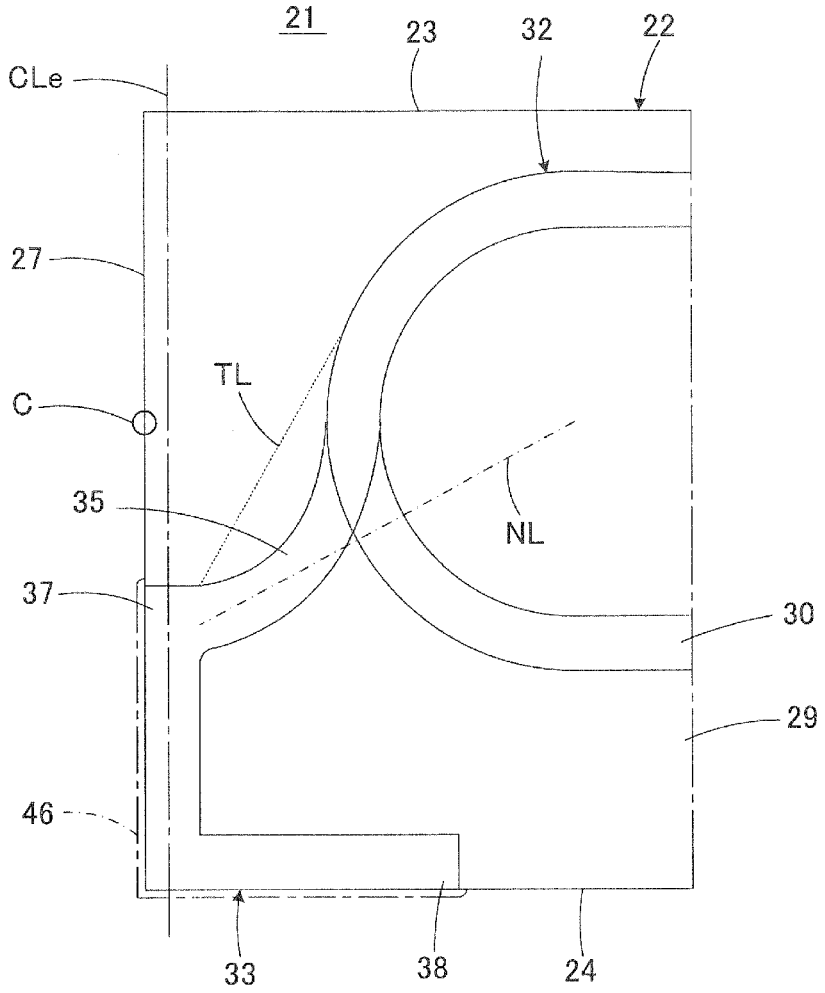
FIG. 3 is a view illustrating a part of the coil component of FIG. 1 in a see-through manner in the direction of a center axis line of a coil conductor, and in particular, is a view for explaining the characteristic configuration related to an extended conductor layer.

In the coil component 21, the characteristic configuration of the embodiment is as follows. The characteristic configuration of the embodiment will be described with reference to FIG. 3. Note that FIG. 3 illustrates the first extended conductor layer 35 only and does not illustrate the second extended conductor layer 36. However, the configuration related to the second extended conductor layer 36 is substantially the same as the configuration related to the first extended conductor layer 35. Therefore, the following describes the configuration related to the first extended conductor layer 35 and omits description of the configuration related to the second extended conductor layer 36.

As illustrated in FIG. 3 clearly, when seen in the direction of the center axis line of the coil conductor 32, the first external terminal electrode 33 has first and second end portions 37 and 38. The first end portion 37 of these end portions 37 and 38 is one end portion located at a farther position relative to the second external terminal electrode 34. The first end portion 37 is located at the first end surface 27.

The first extended conductor layer 35 is extended in the direction toward the first main surface 23 from the first end portion 37 located at the farther position in a state of forming a uniform end edge. Moreover, the first extended conductor layer 35 connects one end of the coil conductor 32 and the first external terminal electrode 33 with a distance larger than a distance extending in a normal line NL direction of the outer peripheral edge of the circulating conductor layer 30 and equal to or smaller than a distance extending in a tangent line TL direction of the outer peripheral edge of the circulating conductor layer 30.

Although not described with reference to the drawings in particular, the second extended conductor layer 36 also connects the other end of the coil conductor 32 and one end portion 39 (see FIG. 4) of the second external terminal electrode 34 in substantially the same manner as the case of the first extended conductor layer 35.

As described above, the first and second extended conductor layers 35 and 36 are extended from the one end portions 37 and 39 of the first and second external terminal electrodes 33 and 34, which are located at the farther positions relative to the other external terminal electrodes, respectively, in the state of forming the uniform end edges. With this, the areas of the external terminal electrodes 33 and present around connection places thereof to the extended conductor layers 35 and 36 can be decreased.

Therefore, the magnetic flux is not easy to be shielded and stray capacitance is not easy to be generated. Further, return loss of signals moving from the extended conductor layers 35 and 36 to the coil conductor 32 can be suppressed.

The first and second extended conductor layers 35 and 36 connect the one end and the other end of the coil conductor 32 and the first and second external terminal electrodes 33 and 34, respectively, with the distances larger than the distances extending in the normal line NL directions of the outer peripheral edges of the circulating conductor layers 30 and equal to or smaller than the distances extending in the tangent line TL directions of the outer peripheral edges of the circulating conductor layers 30. Therefore, the lengths and the areas of the extended conductor layers 35 and 36, which do not form the circulating portions of the coil conductor 32, can be suppressed to a minimum.

Accordingly, increase in the electric resistance and influence by the shielding of the magnetic flux can be suppressed.

Moreover, the extended conductor layers 35 and 36 are extended in the directions toward the first main surface 23 from the external terminal electrodes 33 and 34. Therefore, the extended conductor layers 35 and 36 have the same circulating directions as the circulating conductor layers 30 of the coil conductor 32. Accordingly, the extended conductor layers 35 and 36 themselves also contribute to acquisition of the inductance of the coil conductor 32 efficiently and can contribute to increase in the number of turns in the same laminate plane, as a result.

These advantages can contribute to improvement in the inductance value and the Q value of the coil component 21, as a result.

In the embodiment, as illustrated in FIG. 3 clearly, the first and second extended conductor layers 35 and 36 extend in forms of curves having centers C on outer side portions of the substantially ring-like trajectory defining the forms of the circulating conductor layers 30 when seen in a direction of the center axis line of the coil conductor 32. With this configuration, in manufacturing of the coil component 21, even when a cut position is deviated in a cut process of obtaining the end surfaces 27 and 28 of the component main body 22, as indicated by a cut line CLe, for example, the extended conductor layers 35 and 36 can be made difficult to be cut. Accordingly, dimensions of the external terminal electrodes 33 and 34 are not easy to vary.

Figure 4:
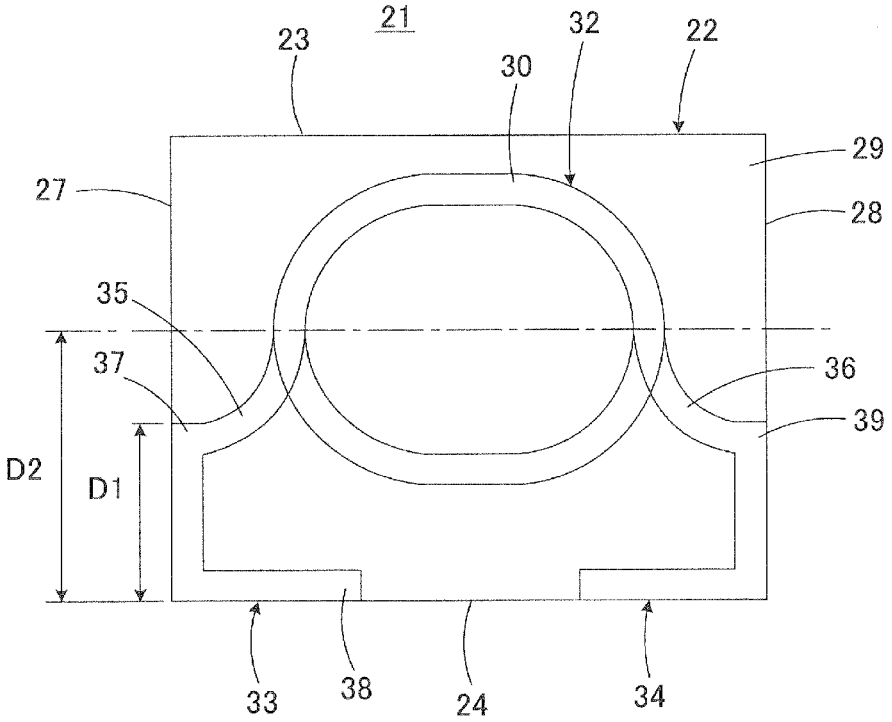
FIG. 4 is a view illustrating the coil component of FIG. 1 in the see-through manner in the direction of the center axis line of the coil conductor, and in particular, is a view for explaining positional relations between the coil conductor and external terminal electrodes.

Further, in the embodiment, as illustrated in FIG. 4 clearly, a distance D1 from the second main surface 24 to the one end portions 37 and 39 of the first and second external terminal electrodes 33 and 34 is made shorter than a distance D2 from the second main surface 24 to the center axis line of the coil conductor 32. With this configuration, the shielding of the magnetic flux and the generation of the stray capacitance can be further suppressed. It should be noted that the above distance D1 may be larger than the above distance D2 when these advantages are not desired to be obtained.

The coil component 21 is preferably manufactured as follows. Description will be made with reference to FIGS. 5A to 5D.

Figure 5A:
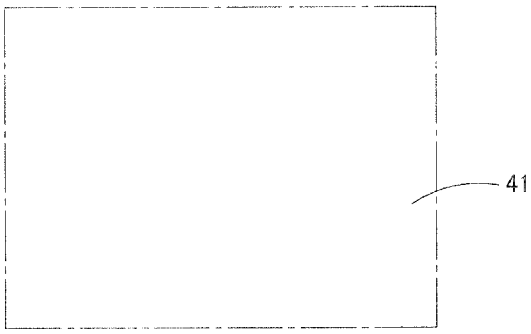
FIGS. 5A to 5D are views for explaining a method of manufacturing the coil component of FIG. 1.

1. Application of an insulating paste containing borosilicate glass as a main component, for example, by screen printing is repeated, so that an insulating paste layer 41 as illustrated in FIG. 5A is formed. The insulating paste layer 41 should form the insulating layer 29-1 as illustrated in FIG. 2.

2. A photosensitive conductive paste layer 42 is applied and formed onto the above insulating paste layer 41. Then, patterning is performed on the photosensitive conductive paste layer 42 by employing a photolithography technique so as to obtain the circulating conductor layers 30-1, the first extended conductor layers 35, the first external terminal electrodes 33, and the second external terminal electrodes 34, as illustrated in FIG. 5B.

To be more specific, for example, photosensitive conductive pastes containing Ag as a metal main component are used and the photosensitive conductive pastes are applied by the screen printing, so that the photosensitive conductive paste layer 42 is formed. Then, the photosensitive conductive paste layer 42 is irradiated with ultraviolet rays or the like with a photo mask interposed therebetween and is developed with an alkaline solution or the like.

Figure 5B:
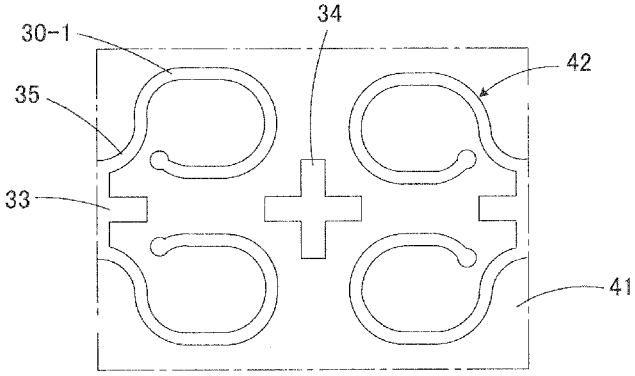

In this manner, as illustrated in FIG. 5B, the patterned photosensitive conductive paste layer 42 is obtained.

Figure 5C:
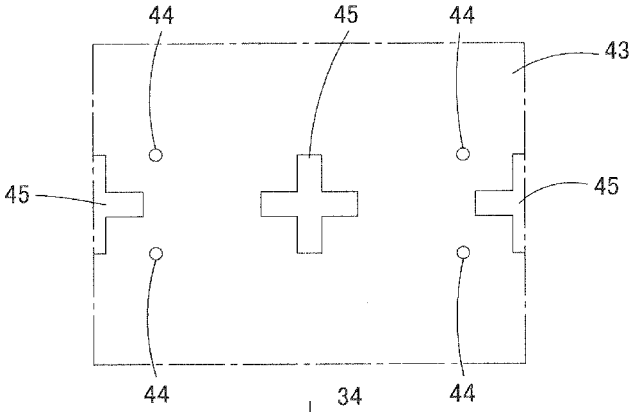

3. An insulating paste layer 43 is formed on the above insulating paste layer 41, as illustrated in FIG. 5C.

To be more specific, photosensitive insulating pastes are applied onto the insulating paste layer 41 by the screen printing, so that the insulating paste layer 43 is formed. Then, the insulating paste layer 43 formed with the photosensitive insulating pastes is irradiated with the ultraviolet rays or the like through a photo mask and is developed with the alkaline solution or the like. With this, as illustrated in FIG. 5C, round holes 44 for forming the via hole conductors 31-1 and cross-shaped holes 45 for forming the external terminal electrodes 33 and 34 are formed.

The insulating paste layer 43 becomes the insulating layer 29-2.

Figure 5D:
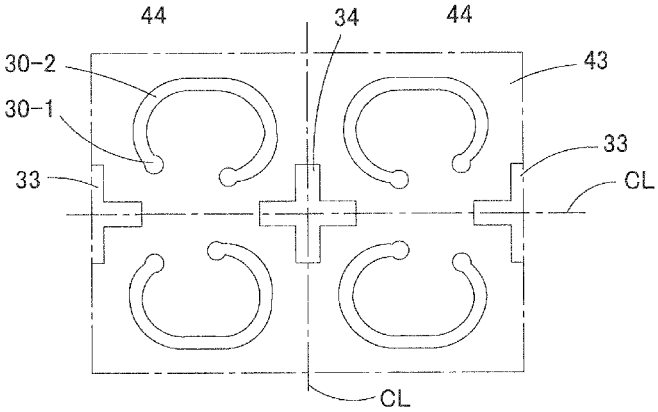

4. As illustrated in FIG. 5D, the circulating conductor layers 30-2, the external terminal electrodes 33 and 34, and the via hole conductors 31-1 are formed by the photolithography technique.

To be more specific, for example, photosensitive conductive pastes containing Ag as a metal main component are applied by the screen printing, so that a photosensitive conductive paste layer is formed. In this case, the round holes 44 and cross-shaped holes 45 as described above are filled with the photosensitive conductive pastes. Subsequently, the photosensitive conductive paste layer is irradiated with the ultraviolet rays or the like through a photo mask and is developed with the alkaline solution or the like.

In this manner, the via hole conductors 31-1 are formed in the round holes 44, the external terminal electrodes 33 and 34 are formed in the cross-shaped holes 45, and the circulating conductor layers 30-2 are formed on the insulating paste layer 43.

5. Subsequently, processes the same as the above processes 3 and 4 are repeated. The circulating conductor layers 30-3 to 30-5, the via hole conductors 31-2 to 31-4, the external terminal electrodes 33 and 34, and the second extended conductor layers 36 are formed while the insulating paste layers forming the respective insulating layers 29-3 to 29-5 are sequentially formed. Finally, a formation process of the insulating paste layer which becomes the insulating layer 29-6 is executed, thereby obtaining a mother multilayer body.

6. The mother multilayer body is cut with a dicing machine or the like and a plurality of non-calcined component main bodies are obtained. FIG. 5D illustrates positions of cut lines CL that are used in the process of cutting the mother multilayer body. As is seen from the positions of the cut lines CL, the external terminal electrodes 33 and 34 are exposed on cut surfaces obtained by cutting.

7. The non-calcined component main bodies are calcined at predetermined conditions, thereby obtaining the component main bodies 22. For example, barrel polishing processing is performed on the component main bodies 22.

8. In the above manner, the coil component 21 is completed. As is indicated by an imaginary line in FIG. 3 for the external terminal electrode 33, plating films 46 are formed on portions of the external terminal electrodes 33 and 34, which are exposed from the component main body 22, if necessary. The plating film 46 is formed by a Ni-plated layer having the thickness of 2 μm to 10 μm, for example, and a Sn-plated layer having the thickness of 2 μm to 10 μm, which is formed on the Ni-plated layer.

Dimensions of the coil component 21 obtained as described above are not particularly limited. When expressed as L×W×T using the dimensions of L, W, and T as illustrated in FIG. 1, dimensions of approximately 0.4 mm×0.2 mm×0.2 mm, 0.6 mm×0.3 mm×0.3 mm, 0.6 mm×0.3 mm×0.2 mm, 0.6 mm×0.3 mm×0.25 mm, 0.4 mm×0.2 mm×0.15 mm, 0.4 mm×0.2 mm×0.1 mm, or the like can be employed.

Further, a conductor pattern formation method that is executed in the above processes 2 and 4 and the like is not limited to employment of the photolithography technique as described above. For example, a printing lamination method of the conductive pastes using a screen plate opened to have a conductor pattern shape, a method of patterning, by etching a conductor film formed by a sputtering method, a deposition method, a foil pressure-bonding method, or the like, or a method in which as in a semi-additive method, a negative pattern is formed and a conductor pattern is formed by a plating film, and then, unnecessary portions are removed may be employed.

Further, the conductor material is not limited to Ag as described above and may be any other good conductors such as Cu and Au. An application method of the conductor material is not limited to use the pastes and the conductor material may be applied by the sputtering method, the deposition method, the foil pressure-bonding method, the plating method, or the like.

Further, a method such as pressure bonding, spin coating, spray application, or the like of an insulating material sheet may be employed for formation of the insulating paste layer, which is executed in the above processes 1 and 3. When the round holes 44 and the cross-shaped holes 45 are formed in the above process 3, a method by processing with laser or a drill may be employed.

Moreover, the insulating material that is contained in the insulating layer 29 is not limited to glass or ceramics, and for example, may be a resin material such as an epoxy resin and a fluororesin, or may be a composite material such as a glass epoxy resin. It should be noted that the insulating material is desirably a material with a low dielectric constant and low dielectric loss.

In the above manufacturing method, the external terminal electrodes 33 and 34 are configured by a portion that is formed with the conductive pastes at the same time as the formation of the circulating conductor layers 30 and a portion that is formed with the conductive pastes which are filled into the cross-shaped holes 45. Accordingly, accuracy of the positional relations between the external terminal electrodes 33 and 34 and the extended conductor layers 35 and 36 can be made extremely high with ease. Accordingly, as described above, the state where the first and second extended conductor layers 35 and 36 are extended from the one end portions 37 and 39 of the first and second external terminal electrodes 33 and 34, which are located at the farther positions relative to the other external terminal electrodes, respectively, in the state of forming uniform end edges, can be realized easily.

As a result, relatively high positional accuracy of the plating films 46 formed in the above process 8 can be maintained. However, the disclosure is not limited to the above method. After the external terminal electrodes 33 and 34 are exposed by cutting, the conductive pastes may be applied by printing or a metal film may be formed by the sputtering method or the like, and then, a plating process may be executed thereon.

Next, characteristics of the coil component 21 in the embodiment of the disclosure, in particular, the inductance value and the Q value are discussed.

Figure 6:
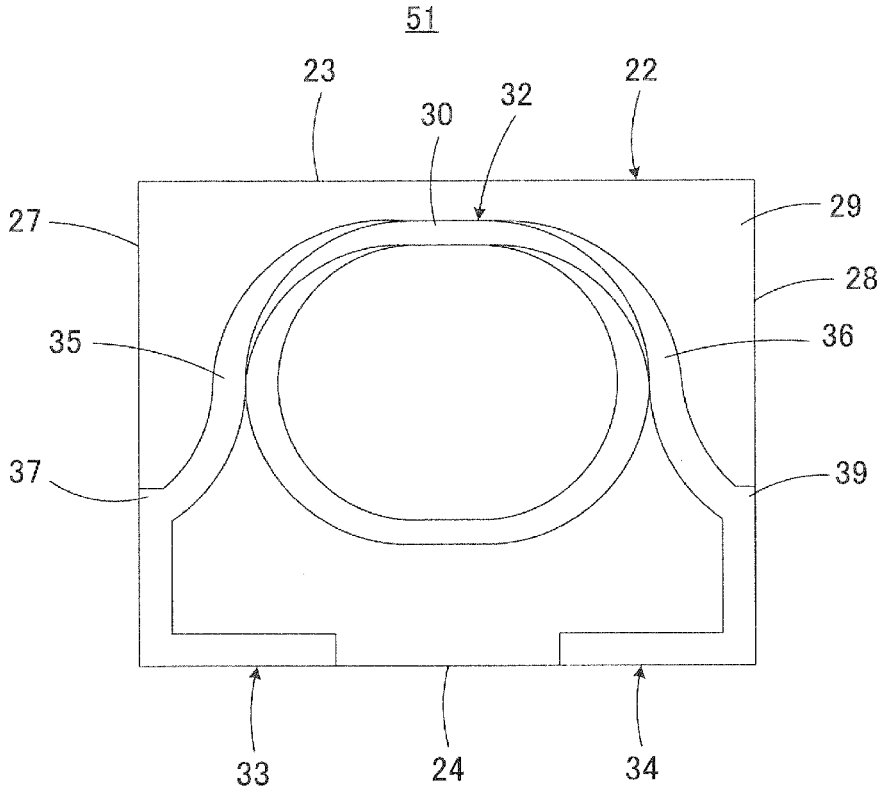
FIG. 6 is a view illustrating a coil component as a comparative example in a see-through manner in the direction of the center axis line of the coil conductor, and corresponds to FIG. 4.

FIG. 6 illustrates a coil component 51 as a comparative example that is out of the scope of the disclosure with the manner same as that in FIG. 4. In FIG. 6, the same reference numerals denote elements corresponding to the elements as illustrated in FIG. 4 and overlapped description thereof is omitted.

The coil component 51 as illustrated in FIG. 6 does not satisfy the condition of the disclosure, that is, the condition that the first and second extended conductor layers 35 and 36 connect the one end and the other end of the coil conductor 32 and the first and second external terminal electrodes 33 and 34, respectively, with the distances larger than the distances extending in the normal line directions of the outer peripheral edges of the circulating conductor layers 30 and equal to or smaller than the distances extending in the tangent line directions of the outer peripheral edges of the circulating conductor layers 30 when seen in the direction of the center axis line of the coil conductor 32. That is to say, the extended conductor layers 35 and 36 do not overlap with the circulating conductor layers 30 and connect the one end and the other end of the coil conductor 32 and the first and second external terminal electrodes 33 and 34, respectively, with distances larger than the distances extending in the tangent line directions of the outer peripheral edges of the circulating conductor layers 30.

Figure 7:
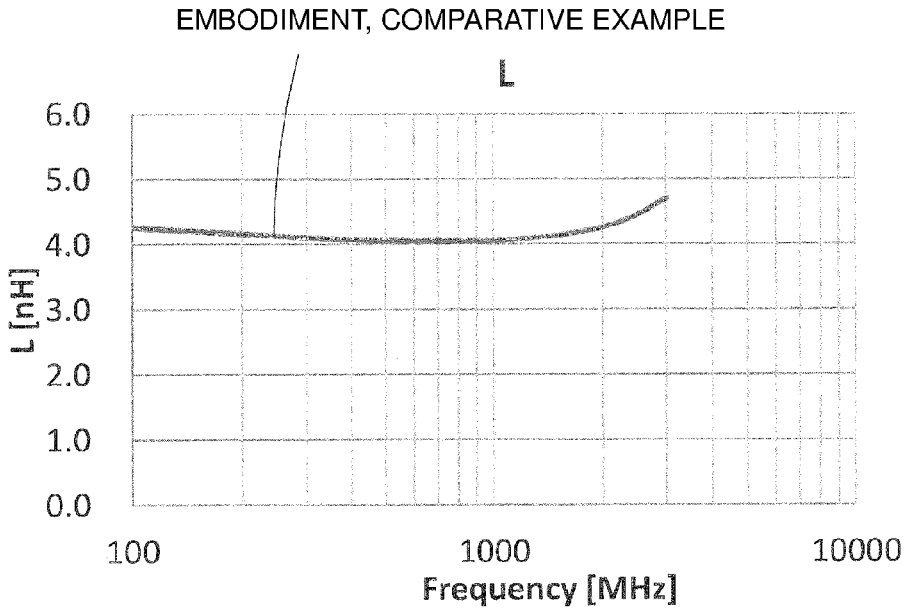
FIG. 7 is a graph for inductance values when compared between the coil component (embodiment) including the extended conductor layers in the form as illustrated in FIG. 4 and the coil component (comparative example) including the extended conductor layers in the form as illustrated in FIG. 6.
Figure 8:
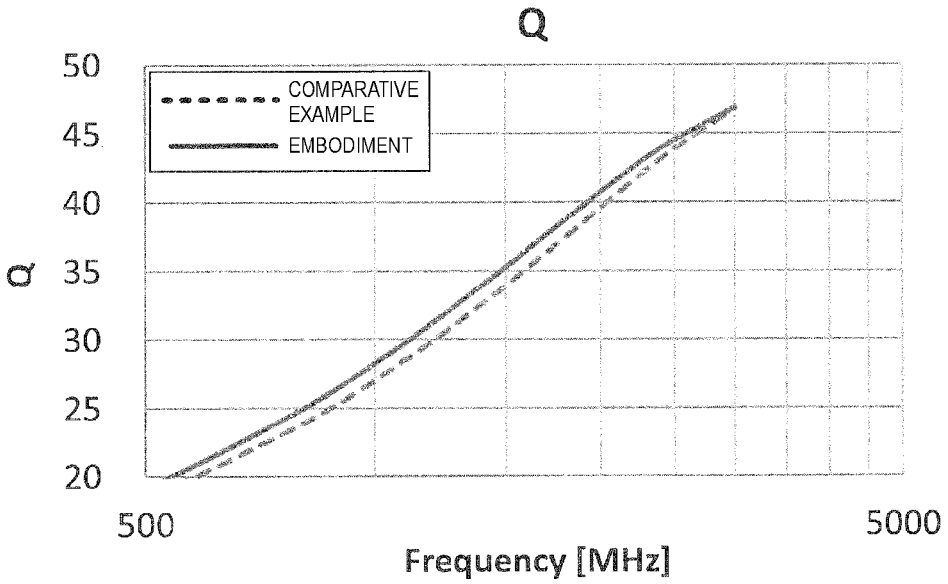
FIG. 8 is a graph for Q values when compared between the coil component (embodiment) including the extended conductor layers in the form as illustrated in FIG. 4 and the coil component (comparative example) including the extended conductor layers in the form as illustrated in FIG. 6.

FIG. 7 illustrates results for frequency characteristics of the inductance (L) value of the coil component 21 in the embodiment as illustrated in FIG. 4 and frequency characteristics of the inductance (L) value of the coil component 51 in the comparative example as illustrated in FIG. 6, which were obtained by simulation. On the other hand, FIG. 8 illustrates results for frequency characteristics of the Q value of the coil component 21 in the embodiment as illustrated in FIG. 4 and frequency characteristics of the Q value of the coil component 51 in the comparative example as illustrated in FIG. 6, which were obtained by simulation. The dimensions of the coil components 0.4 mm×0.2 mm×0.3 mm when expressed as L×W×T using the dimensions of L, W, and T as illustrated in FIG. 1.

First, for the frequency characteristics of the inductance (L) value as illustrated in FIG. 7, no significant difference was observed between the embodiment and the comparative example and curves indicating the L-frequency characteristics were substantially overlapped with each other. On the other hand, for the frequency characteristics of the Q value as illustrated in FIG. 8, the higher Q value was obtained in the embodiment rather than that in the comparative example. It is estimated that the Q value was lower in the comparative example because regions where the extended conductor layers 35 and 36 shielded the magnetic flux were larger in the comparative example than those in the embodiment and the distances from the external terminal electrodes 33 and 34 to the circulating conductor layers 30 were large and the resistance was therefore increased.

Figure 9:
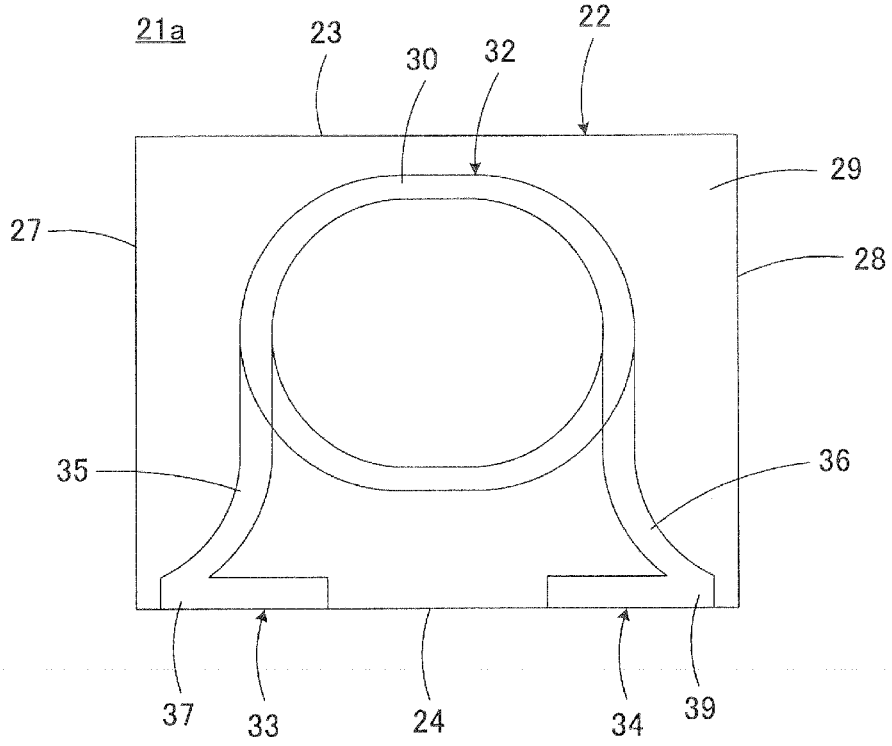
FIG. 9 is a view illustrating a coil component according to a second embodiment of the disclosure in a see-through manner in the direction of the center axis line of the coil conductor.

Next, a coil component 21*a* according to a second embodiment of the disclosure will be described with reference to FIG. 9. FIG. 9 illustrates the coil component 21*a* with the manner the same as that in FIG. 4. In FIG. 9, the same reference numerals denote elements corresponding to the elements as illustrated in FIG. 4 and overlapped description thereof is omitted.

The coil component 21*a* as illustrated in FIG. 9 has a characteristic that the external terminal electrodes 33 and 34 are arranged only at the second main surface 24, that is, the bottom surface of the component main body 22, in short words. The coil component 21*a* can decrease the mounting area. On the other hand, in the coil component 21, because the one end portions 37 and 39 of the first and second external terminal electrodes are located at the first and second end surfaces 27 and 28, respectively, the external terminal electrodes 33 and 34 can extend in substantially L-shaped forms along the surfaces of the component main body 22.

In the coil component 21*a*, the one end portions 37 and 39 of the first and second external terminal electrodes 33 and 34, which are located at the farther positions relative to the other external terminal electrodes, are located at the second main surface 24 and the first and second extended conductor layers 35 and 36 extend in the directions toward the first main surface 23 from portions thereof connected to the first and second external terminal electrodes 33 and 34, respectively.

Also in the coil component 21*a*, the first and second extended conductor layers 35 and 36 are extended in the directions toward the first main surface 23 from the one end portions 37 and 39 of the first and second external terminal electrodes 33 and 34, which are located at the farther positions relative to the other external terminal electrodes, respectively, in the state of forming the uniform end edges when seen in the direction of the center axis line of the coil conductor 32.

Figure 10:
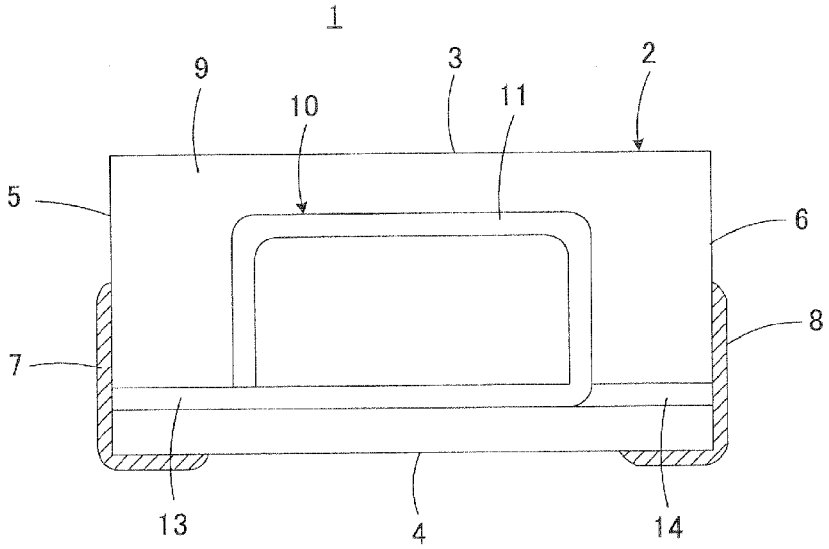
FIG. 10 PRIOR ART
FIG. 10 is a view illustrating an existing coil component in a see-through manner in a direction of a center axis line of a coil conductor.

Hereinbefore, the disclosure has been described using several embodiments as illustrated in the drawings. However, many other variations can be made in the scope of the disclosure. Although the circulating conductor layers 30 as illustrated in the drawings have the planar form extending along the substantially oval-shaped ring-like trajectory, they may have a planar form extending along a substantially ring-like trajectory having a shape closer to a rectangle, like the circulating conductor layers 11 as illustrated in FIG. 10, for example.

Further, the embodiments as described in the specification are exemplary and partial replacement or combination of the configurations can be made between the different embodiments.

While embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a component main body that has a rectangular parallelepiped shape including first and second main surfaces opposing each other, and first and second side surfaces opposing each other and first and second end surfaces opposing each other, which connect the first and second main surfaces, and has a laminate structure in which a plurality of insulating layers are laminated in a direction orthogonal to the side surfaces;

a coil conductor that is arranged in the component main body, is configured by a plurality of circulating conductor layers each of which extends so as to form a part of a ring-like trajectory along an interface between the insulating layers and a plurality of via hole conductors penetrating through the insulating layers in a thickness direction, and extends in a helical form by alternately connecting the circulating conductor layers and the via hole conductors;

first and second external terminal electrodes that are arranged at a region including the second main surface at the first end surface side and a region including the second main surface at the second end surface side, respectively, but are not arranged at the first main surface and regions of the first and second end surfaces at the first main surface side; and first and second extended conductor layers that are arranged along interfaces between the insulating layers and connect one end and the other end of the coil conductor and the first and second external terminal electrodes, respectively, wherein the first and second extended conductor layers, when seen in a direction of a center axis line of the coil conductor, are extended in directions toward the first main surface from one end portion of the first external terminal electrode and one end portion of the second external terminal electrode, which are located at farther positions relative to the other external terminal electrodes, respectively, in a state of forming uniform end edges, and connect the one end and the other end of the coil conductor and the first and second external terminal electrodes, respectively, wherein the first extended conductor layer connects the one end portion of the coil conductor and the first external terminal electrode, wherein a length of the first extended conductor layer along a centerline thereof is larger than a distance extending in a normal line direction of the outer peripheral edge of the circulating conductor layer from the outer peripheral edge of the circulating conductor layer to an intersection with the first external terminal electrode, and wherein the length of the first extended conductor layer along the centerline thereof is equal to or smaller than a distance extending in a tangent line direction of the outer peripheral edge of the circulating conductor layer from the outer peripheral edge of the circulating conductor layer to the intersection with the first external terminal electrode, and wherein the second extended conductor layer connects the other end portion of the coil conductor and the second external terminal electrode, wherein a length of the second extended conductor layer along a centerline thereof is larger than a distance extending in a normal line direction of the outer peripheral edge of the circulating conductor layer from the outer peripheral edge of the circulating conductor layer to an intersection with the second external terminal electrode, and wherein the length of the second extended conductor layer along the centerline thereof is equal to or smaller than a distance extending in a tangent line direction of the outer peripheral edge of the circulating conductor layer from the outer peripheral edge of the circulating conductor layer to the intersection with the second external terminal electrode.

2. The coil component according to claim 1, wherein the one end portions of the first and second external terminal electrodes are located at the first and second end surfaces, respectively.

3. The coil component according to claim 2, wherein distances to the one end portions of the first and second external terminal electrodes from the second main surface are smaller than a distance to the center axis line of the coil conductor from the second main surface.

4. The coil component according to claim 1, wherein the one end portions of the first and second external terminal electrodes are located at the second main surface.

5. The coil component according to claim 1, wherein the first and second extended conductor layers extend in forms of curves having centers on outer side portions of the ring-like trajectory when seen in a direction of the center axis line of the coil conductor.

* * * * *